US005901576A

United States Patent [19]

Agrawal et al.

[11] Patent Number: 5,901,576

[45] Date of Patent: May 11, 1999

[54] SINGLE EXPANDER AND A COLD COMPRESSOR PROCESS TO PRODUCE OXYGEN

[75] Inventors: Rakesh Agrawal, Emmaus; Donn Michael Herron, Fogelsville; Yanping Zhang, Wescosville, all of Pa.

[73] Assignee: Air Products and Chemicals, Inc., Allentown, Pa.

[21] Appl. No.: 09/010,966

[22] Filed: Jan. 22, 1998

[51] Int. Cl.[6] ..... F25J 3/00

[52] U.S. Cl. ..... 62/646; 62/652

[58] Field of Search ..... 62/646, 652

[56] References Cited

U.S. PATENT DOCUMENTS

| | | | |
|---|---|---|---|
| 2,753,698 | 7/1956 | Jakob | 62/123 |
| 4,072,023 | 2/1978 | Springmann | 62/13 |
| 4,410,343 | 10/1983 | Ziemer | 62/29 |
| 4,704,148 | 11/1987 | Kleinberg | 62/24 |
| 4,883,519 | 11/1989 | Agrawal et al. | 62/652 |
| 4,936,099 | 6/1990 | Woodward et al. | 62/24 |
| 4,966,002 | 10/1990 | Parker et al. | 62/31 |
| 5,309,721 | 5/1994 | Rathbone | 62/39 |
| 5,385,024 | 1/1995 | Roberts et al. | 62/25 |
| 5,396,772 | 3/1995 | McKeigue et al. | 62/652 |
| 5,475,980 | 12/1995 | Grenier et al. | 62/24 |

FOREIGN PATENT DOCUMENTS

| | | | |
|---|---|---|---|
| 2854508 | 6/1980 | Germany | F25J 3/02 |
| 8800677 | 1/1988 | WIPO | F25J 3/02 |

*Primary Examiner*—Ronald Capossela

*Attorney, Agent, or Firm*—Willard Jones, II

[57] ABSTRACT

In a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, which comprises the steps of: (a) generating work energy which is in excess of the overall refrigeration demand of the distillation column system by at least one of the following three methods: (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; and (3) work expanding a fraction of the feed air; (b) using the work which is generated in excess of the refrigeration need of the distillation column system to cold compress a process stream at a temperature lower than the ambient temperature.

37 Claims, 6 Drawing Sheets

SINGLE EXPANDER AND A COLD COMPRESSOR PROCESS TO PRODUCE OXYGEN

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to several methods for efficient production of oxygen by cryogenic air separation. In particular, the present invention relates to cryogenic air separation processes where it is attractive to produce at least a portion of the total oxygen with purity less than 99.5% and, preferably, less than 97%.

There are numerous U.S. patents that teach the efficient production of oxygen with purity less than 99.5%. Two examples are U.S. Pat. Nos. 4,704,148 and 4,936,099.

U.S. Pat. No. 2,753,698 discloses a method for the fractionation of air in which the total air to be separated is prefractionated in the high pressure column of a double rectifier to produce a crude (impure) liquid oxygen (crude LOX) bottoms and a gaseous nitrogen overhead. The so produced crude LOX is expanded to a medium pressure and is completely vaporized by heat exchange with condensing nitrogen. The vaporized crude oxygen is then slightly warmed, expanded against a load of power production and scrubbed in the low pressure column of the double rectifier by the nitrogen condensed within the high pressure column and entered on top of the low pressure column. The bottom of the low pressure column is reboiled with the nitrogen from the high pressure column. This method of providing refrigeration will henceforth be referred to as CGOX expansion. In this patent, no other source of refrigeration is used. Thus, the conventional method of air expansion to the low pressure column is replaced by the proposed CGOX expansion. As a matter of fact, it is cited in this patent that the improvement results because additional air is fed to the high pressure column (as no gaseous air is expanded to the low pressure column) and this results in additional nitrogen reflux being produced from the top of the high pressure column. It is stated that the amount of additional nitrogen reflux is equal to the additional amount of nitrogen in the air that is fed to the high pressure column. An improvement in the efficiency of scrubbing with liquid nitrogen in the upper part of the low pressure column is claimed to overcome the deficiency of boil-up in the lower part of the low pressure column.

U.S. Pat. No. 4,410,343 discloses a process for the production of low purity oxygen which employs a low pressure and a medium pressure column, wherein the bottoms of the low pressure column are reboiled against condensing air and the resultant air is fed into both the medium pressure and low pressure columns.

U.S. Pat. No. 4,704,148 discloses a process utilizing high and low pressure distillation columns for the separation of air to produce low purity oxygen and a waste nitrogen stream. Feed air from the cold end of the main heat exchangers is used to reboil the low pressure distillation column and to vaporize the low purity oxygen product. The heat duty for the column reboil and oxygen product vaporization is supplied by condensing air fractions. In this patent, the air feed is split into three substreams. One of the substreams is totally condensed and used to provide reflux to both the low pressure and high pressure distillation columns. A second substream is partially condensed with the vapor portion of the partially condensed substream being fed to the bottom of the high pressure distillation column and the liquid portion providing reflux to the low pressure distillation column. The third substream is expanded to recover refrigeration and then introduced into the low pressure distillation column as column feed. Additionally, the high pressure column condenser is used as an intermediate reboiler in the low pressure column.

In international patent application #PCT/US87/01665 (U.S. Pat. No. 4,796,431), Erickson teaches a method of withdrawing a nitrogen stream from the high pressure column, partially expanding this nitrogen to an intermediate pressure and then condensing it by heat exchange against either crude LOX from the bottom of the high pressure column or a liquid from an intermediate height of the low pressure column. This method of refrigeration will now be referred to as nitrogen expansion followed by condensation (NEC). Generally, NEC provides the total refrigeration need of the cold box. Erickson teaches that only in those applications where NEC alone is unable to provide the refrigeration need, that supplemental refrigeration is provided through the expansion of some feed air. However, use of this supplemental refrigeration to reduce energy consumption is not taught. This supplemental refrigeration is taught in the context of a flowsheet where other modifications to the flowsheets were done to reduce the supply air pressure. This reduced the pressure of the nitrogen to the expander and therefore the amount of refrigeration available from NEC. In this patent, Erickson also teaches the use of two NEC. The nitrogen from the high pressure column is split into two streams, and each stream is partially expanded to different pressures and condensed against different liquids. For example, one expanded nitrogen stream is condensed against crude LOX and the other is condensed against an intermediate height liquid from the low pressure column. Erickson claims that the use of a second NEC increases the refrigeration output that can be used to power a cold compressor so as to further increase oxygen delivery pressure.

In U.S. Pat. No. 4,936,099, Woodward et al use CGOX expansion in conjunction with the production of low purity oxygen. In this case, gaseous oxygen product is produced by vaporizing liquid oxygen from the bottom of the low pressure column by heat exchange against a portion of the feed air.

In some air separation plants, excess refrigeration is naturally available. This is generally for either of two reasons: an operating equipment constraint leads to excess flow through the expander, and recovery of the product from the distillation system is low and it produces excess waste at an elevated pressure which is then expanded. In such cases, some patents have suggested to use excess refrigeration for compressing a suitable process stream at cryogenic temperatures. This method of compression at cryogenic temperatures will hereinafter be referred to as cold compression.

An example of the creation of excess refrigeration due to the first reason and then use of cold compression can be found in U.S. Pat. No. 4,072,023. In this patent, reversing heat exchangers are used to remove water and carbon dioxide from the feed air. A successful operation of such a reversing heat exchanger requires that a balance stream be used. The balance stream is generally drawn from the distillation column system, then partially warmed in the cold part of the main heat exchanger in indirect heat exchange with the incoming feed air, and then expanded in an expander to provide the needed refrigeration. Unfortunately, the flow rate of this balance stream cannot be reduced below a certain fraction of the feed air flow rate. For large size plants where the refrigeration demand per unit of product flow is not that large, the constraint of having a balance stream flow above a certain fraction of the feed air flow produces excess refrigeration. In this patent, a predominantly nitrogen containing or a predominantly oxygen containing cold stream from a double column process is expanded in an expander. Some of the work energy from this expander is used to compress a process stream which is at a temperature between that of the double distillation column and the cold end of the main heat exchanger. This patent teaches this cold compression scheme in context with a conventional double column process where the top of a high pressure column is thermally linked with the bottom of the low pressure column.

Examples of the creation of excess refrigeration due to the second reason and then use of cold compression can be found in U.S. Pat. Nos. 4,966,002 and 5,385,024. In both of these patents, air is fed near the bottom of a single distillation column to produce high pressure nitrogen. Since a single distillation column with no reboiler at the bottom is used, the recovery of nitrogen is low. This produces a large quantity of oxygen-enriched waste stream at an elevated pressure. A portion of this oxygen-enriched waste stream is partially warmed and expanded to provide the needed refrigeration, and the excess refrigeration is used to cold compress another portion of this waste stream. The cold compressed waste stream is recycled to the distillation column.

In U.S. Pat. No. 5,475,980, cold compression is used to improve the efficiency of cooling in the heat exchanger vaporizing pumped liquid oxygen at a pressure greater than about 15 bar. For this purpose, an auxiliary stream at an intermediate temperature is taken out from an intermediate location of the heat exchanger. This auxiliary stream is then cold compressed and reintroduced in the heat exchanger and further cooled. At least a portion of the further cooled stream is then expanded in an expander. When the pressure of the auxiliary stream to be cold compressed is much higher than the high pressure column pressure, then only a portion of it is expanded to the high pressure column after cold compression and partial cooling. In this case, extra energy is provided at the warm end of the plant to meet the refrigeration and cold compression requirement. However, when the auxiliary stream is withdrawn from the high pressure column, then all of it is expanded after cold compression and cooling. This ensures that most of the energy needed for cold compression is recovered from the expander and used for cold compression. As a result, the need for extra vapor flow through the expander to create work energy is minimal and it does not require excess refrigeration as in the earlier cited U.S. Pat. Nos. 4,072,023; 4,966,002 and 5,385,024.

In DE-28 54 508, a portion of the air feed at the high pressure column pressure is further compressed at the warm level by using work energy from the expander providing refrigeration to the cold box. This further compressed air stream and is then partially cooled and expanded in the same expander that drives the compressor. In this scheme, the fraction of the feed air stream which is further compressed and then expanded for refrigeration is the same. As a result, for a given fraction of the feed air, more refrigeration is produced in the cold box. The patent teaches two methods to exploit this excess refrigeration: (a) to produce more liquid products from the cold box; (b) to reduce flow through the compressor and the expander and thereby increase flow to the high pressure column. It is claimed that an increased flow to the high pressure column would result in a greater product yield from the cold box.

BRIEF SUMMARY OF THE INVENTION

In a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, which comprises the steps of: (a) generating work energy which is in excess of the overall refrigeration demand of the distillation column system by at least one of the following three methods: (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air; (2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; and (3) work expanding a fraction of the feed air; (b) using the work which is generated in excess of the refrigeration need of the distillation column system to cold compress a process stream at a temperature lower than the ambient temperature.

BRIEF DESCRIPTION OF SEVERAL VIEWS OF THE DRAWINGS

In FIGS. 1 through 6, common streams use the same stream reference numbers.

DETAILED DESCRIPTION OF THE INVENTION

Figure 1:
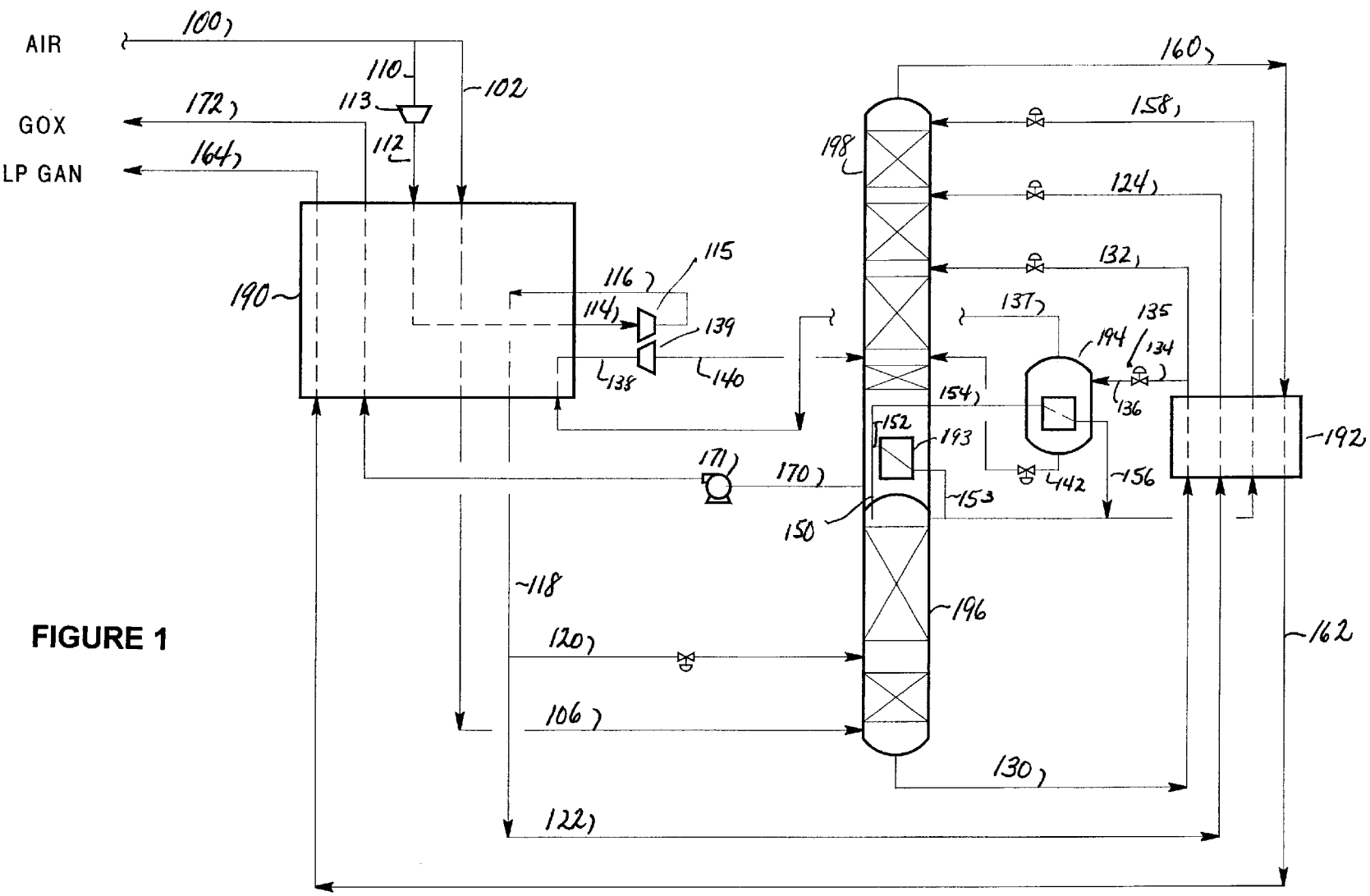
FIGS. 1 through 6 illustrate schematic diagrams of different embodiments of the present invention.

The present invention teaches more efficient cryogenic processes for the production of low purity oxygen. The low-purity oxygen is defined as a product stream with oxygen concentration less than 99.5% and preferably less than 97%. In this method, the feed air is distilled by a distillation system that contains at least one distillation column. The boil-up at the bottom of the distillation column producing the oxygen product is provided by condensing a stream whose nitrogen concentration is either equal to or greater than that in the feed air stream. The invention is comprised of the following steps:

(a) generating work energy which is in excess of the overall refrigeration demand of the distillation column system by at least one of the following three methods:
  (1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air;

(2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; and (3) work expanding a fraction of the feed air;

(b) using the work which is generated in excess of the refrigeration need of the distillation column system to cold compress a process stream at a temperature lower than the ambient temperature.

In the preferred mode, the fraction of the feed air stream in step (a)(3) prior to expansion is cooled to a temperature that is lower than the ambient temperature but above the temperature of the distillation columns. Also, generally (but not always), the work expanded air stream will be fed directly to the distillation system.

In the most preferred mode, the distillation system is comprised of a double column system consisting of a higher pressure (HP) column and a lower pressure (LP) column. At least a portion of the feed air is fed to the HP column. The product oxygen is produced from the bottom of the LP column. The first process stream in step (a)(1) or the second process stream in (a)(2) is generally a high pressure nitrogen-rich vapor stream withdrawn from the HP column. If the work expansion method of step (a)(1) is used, then the high pressure nitrogen-rich vapor stream is expanded and then condensed by latent heat exchange against a liquid stream at an intermediate height of the LP column or the crude liquid oxygen (crude LOX) stream that originates at the bottom of the HP column and forms the feed to the LP column. In this method, the pressure of the crude LOX stream is dropped to the vicinity of the LP column pressure. The high pressure nitrogen-rich stream can be partially warmed prior to expansion. If the work expansion method of step (a)(2) is used, then the high pressure nitrogen-rich stream is condensed by latent heat exchange against at least a portion of the crude LOX stream that is at a pressure higher than the LP column pressure and the resulting vapor from the at least partial vaporization of the crude LOX is work expanded to the LP column. Prior to the work expansion, the resulting vapor from the at least partial vaporization of the crude LOX could be partially warmed. As an alternative to the crude LOX vaporization, an oxygen-enriched liquid with oxygen content greater than air could be withdrawn from the LP column and pumped to the desired pressure greater than the LP column pressure prior to at least partial vaporization. If the work expansion method of process (a)(3) is used, then the work expanded air stream can be directly fed to either the HP column or more preferably to the LP column.

By work expansion, it is meant that when a process stream is expanded in an expander, it generates work. This work may be dissipated in an oil brake, or used to generate electricity or used to directly compress another process stream.

Along with low-purity oxygen, other products can also be produced. This includes high purity oxygen (purity equal to or greater than 99.5%), nitrogen, argon, krypton and xenon. If needed, some liquid products such as liquid nitrogen, liquid oxygen and liquid argon could also be coproduced.

Now the invention will be described in detail with reference to FIG. 1. The compressed feed air stream free of heavier components such as water and carbon dioxide is shown as stream 100. The pressure of this compressed air stream is generally greater than 3.5 bar absolute and less than 24 bar absolute. The preferred pressure range is from 5 bar absolute to about 10 bar absolute. A higher feed air pressure is helpful in reducing the size of the molecular sieve beds used for water and carbon dioxide removal. The feed air stream is divided into two streams, 102 and 110. Stream 102 is cooled in the main heat exchanger 190 and then fed as stream 106 to the bottom of the high pressure (HP) column 196. The feed to the high pressure column is distilled into high pressure nitrogen vapor stream 150 at the top and the crude liquid oxygen (crude LOX) stream 130 at the bottom. The crude LOX stream is eventually fed to a low pressure (LP) column 198 where it is distilled to produce a lower-pressure nitrogen vapor stream 160 at the top and a liquid oxygen product stream 170 at the bottom. Alternatively, oxygen product may be withdrawn from the bottom of the LP column as vapor. The liquid oxygen product stream 170 is pumped by pump 171 to a desired pressure and then vaporized by heat exchange against a suitably pressurized process stream to provide gaseous oxygen product stream 172. In FIG. 1, the suitably pressurized process stream is a fraction of feed air in line 118. The boil-up at the bottom of the LP column is provided by condensing a first portion of the high pressure nitrogen stream from line 150 in line 152 to provide first high pressure liquid nitrogen stream 153.

According to step (a)(2) of the invention, at least a portion of the crude LOX stream having a concentration of oxygen greater than that in feed air is reduced in pressure across valve 135 to a pressure which is intermediate of the HFP and LP column pressures. In FIG. 1, prior to pressure reduction, crude LOX is subcooled in subcooler 192 by heat exchange against the returning gaseous nitrogen stream from the LP column. This subcooling is optional. The pressure-reduced crude LOX stream 136 is sent to a reboiler/condenser 194, where it is at least partially boiled by the latent heat exchange against the second portion of the high pressure nitrogen stream from line 150 in line 154 (the second process stream of (a)(2) of the invention), to provide the second high pressure liquid nitrogen stream 156. The first and second high pressure liquid nitrogen streams provide the needed reflux to the HP and LP columns. The vaporized portion of the pressure-reduced crude LOX stream in line 137 (hereinafter referred to as crude GOX stream) is partially warmed in the main heat exchanger 190 and then work expanded in expander 139 to the LP column 198 as additional feed. Partial warming of crude GOX stream 137 is optional and, similarly, after work expansion stream 140 could be further cooled prior to feeding it to the LP column.

Expander 139 is operated so as to generate more work than is needed for the refrigeration balance of the plant. In a cryogenic air separation plant, all the heat exchangers, distillation columns and the associated valves, pipes and other equipment shown in FIG. 1 are enclosed in an insulated box called the cold box. Since the inside of the box is at subambient temperatures, there is a heat leak from the ambient to the cold box. Also the product streams (such as streams 164 and 172) leaving the cold box are at lower temperatures than the feed air streams. This leads to enthalpy losses due to products leaving the cold box. For a plant to operate, it is essential that both these losses be balanced by extracting an equal amount of energy out from the cold box. Generally this energy is extracted as work energy. In this invention, the work output from expander 139 exceeds the work that must be extracted to keep the cold box in refrigeration balance. This intentionally generated additional work is then used for cold compression of a process stream within the cold box. This way, the additional work does not leave the cold box and the refrigeration balance is maintained.

In FIG. 1, in order to vaporize the pumped liquid oxygen from pump 171, a portion of the feed air stream 100 in stream 110 is further boosted in an optional booster 113 and cooled against cooling water (not shown in the figure) and then partially cooled in the main heat exchanger 190. This partially cooled air stream 114 is then cold compressed by cold compressor 115. The energy input in the cold compressor is the additional work energy generated from expander 139 (i.e. that not needed for refrigeration). The cold compressed stream 116 is then reintroduced in the main heat exchanger where it cools by heat exchange against the pumped liquid oxygen stream. A portion of the cooled liquid air stream 118 is sent to the HP column as stream 120 and another portion (stream 122) is sent to the LP column after some subcooling in subcooler 192.

Several known modifications can be applied to the example flowsheet in FIG. 1. For example, all the crude LOX stream 130 from the HP column may be sent to the LP column and none of it sent to the reboiler/condenser 194. In lieu of this, a liquid is withdrawn from an intermediate height of the LP column and then pumped to a pressure intermediate of the HP and LP column pressures and sent to the reboiler/condenser 194. The rest of the treatment in reboiler/condenser 194 is analogous to that of stream 134, explained earlier. In another modification, the two high pressure nitrogen streams 152 and 154 condensing in reboiler/condenser 193 and 194, respectively, may not originate from the same point in the HP column. Each one may be obtained at different heights of the HP column and after condensation in their reboilers (193 and 194), each is sent to an appropriate location in the distillation system. As one example, stream 154 could be drawn from a position which is below the top location of the high pressure column, and after condensation in reboiler/condenser 194, a portion of it could be returned to an intermediate location of the HP column and the other portion sent to the LP column.

Figure 2:
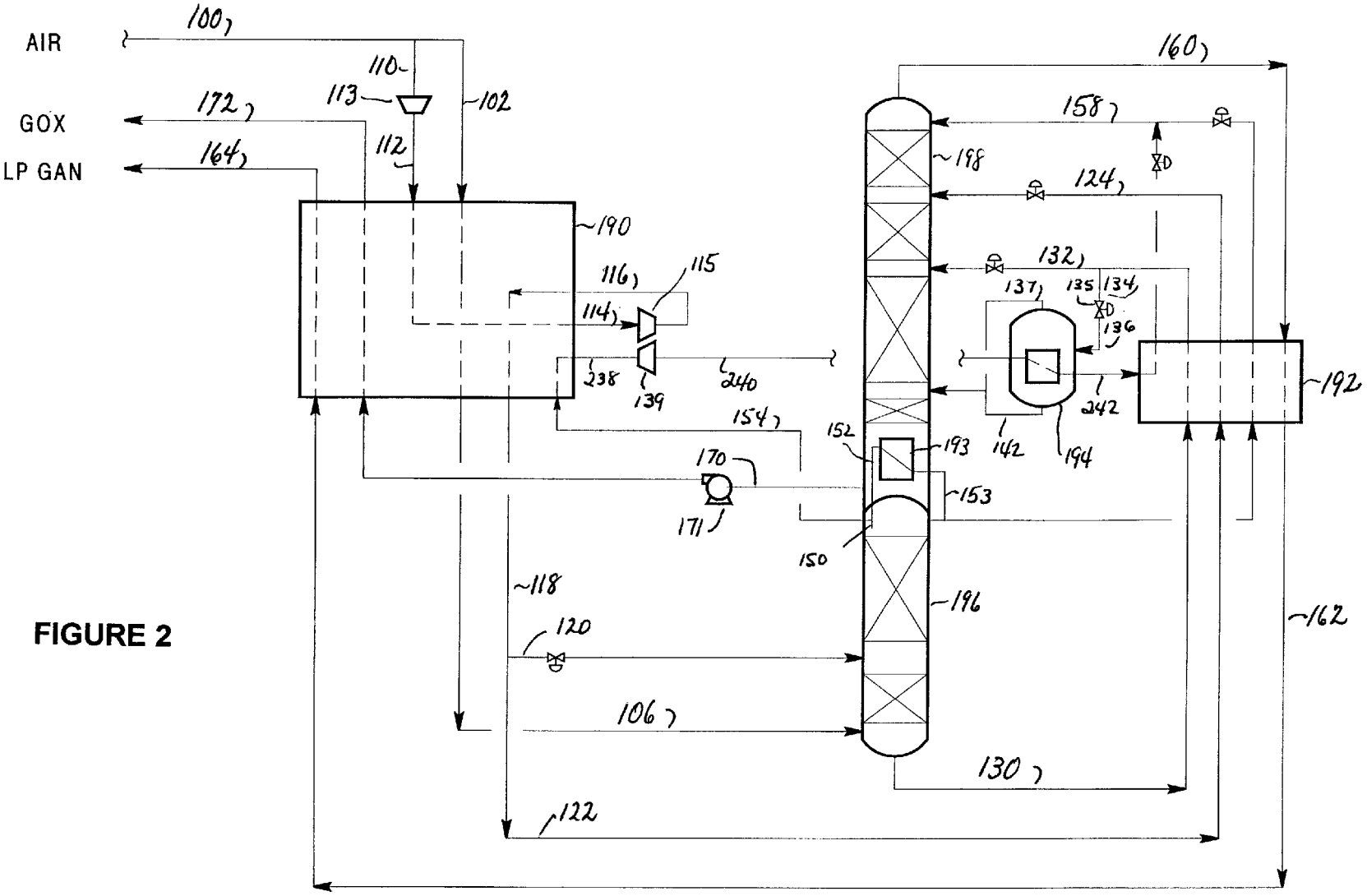

FIG. 2 shows an alternative embodiment where a process stream is work expanded according to step (a)(1). Here, subcooled crude LOX stream 134 is let down in pressure across valve 135 to a pressure that is very close to the LP column pressure and then fed to the reboiler/condenser 194. The second portion of the high pressure nitrogen stream in line 154 (now the first process stream of step (a)(1)) is partially warmed (optional) in the main heat exchanger and then work expanded in expander 139 to provide a lower pressure nitrogen stream 240. This stream 240 is then condensed by latent heat exchange in reboiler/condenser 194 to produce stream 242, which after some subcooling is sent to the LP column. The vaporized stream 137 and the liquid stream 142 from the reboiler/condenser 194 are sent to an appropriate location in the LP column. If needed, a portion of the condensed nitrogen stream in line 242 could be pumped to the HP column. Once again, the two nitrogen streams, one condensing in reboiler/condenser 193 and the other condensing in reboiler/condenser 194, could be drawn from different heights of the HP column and could, therefore, be of different composition.

Figure 3:
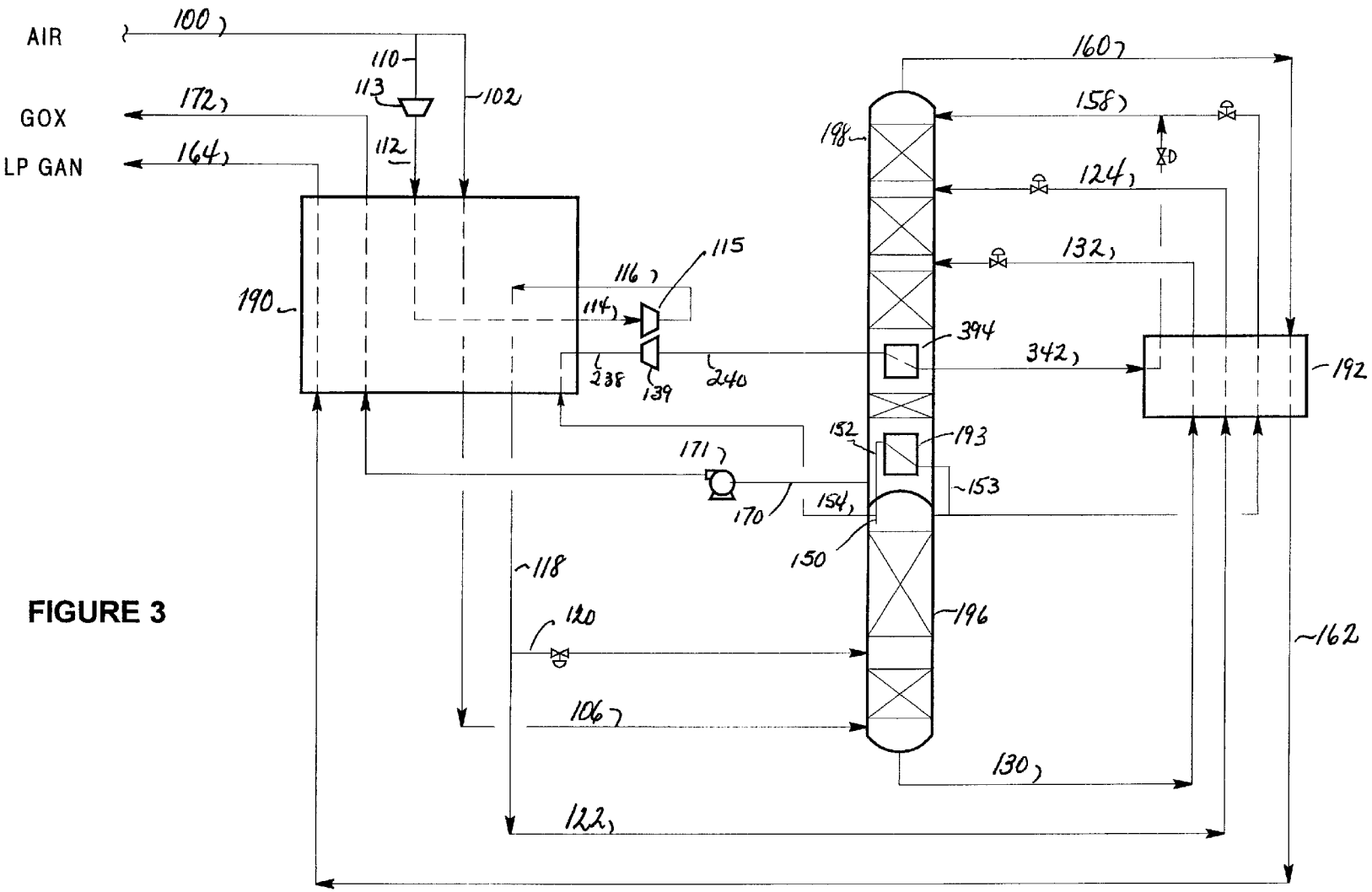

Another variation of FIG. 2 using the work expansion according to step (a)(1) is shown in FIG. 3. In this scheme, reboiler/condenser 194 is eliminated and all of the crude LOX stream from the bottom of the HP column is sent without any vaporization to the LP column. In place of reboiler/condenser 194, an intermediate reboiler 394 is used at an intermediate height of the LP column. Now the work expanded nitrogen stream 240 from expander 139 is condensed in reboiler/condenser 394 by latent heat exchange against a liquid at the intermediate height of the LP column. The condensed nitrogen stream 342 is treated in a manner which is analogous to that in FIG. 2. The other operating features of FIG. 3 are also the same as in FIG. 2.

It is possible to draw several variations of the proposed invention in FIGS. 1–3. Some of these variations will now be discussed as further examples.

Figure 4:
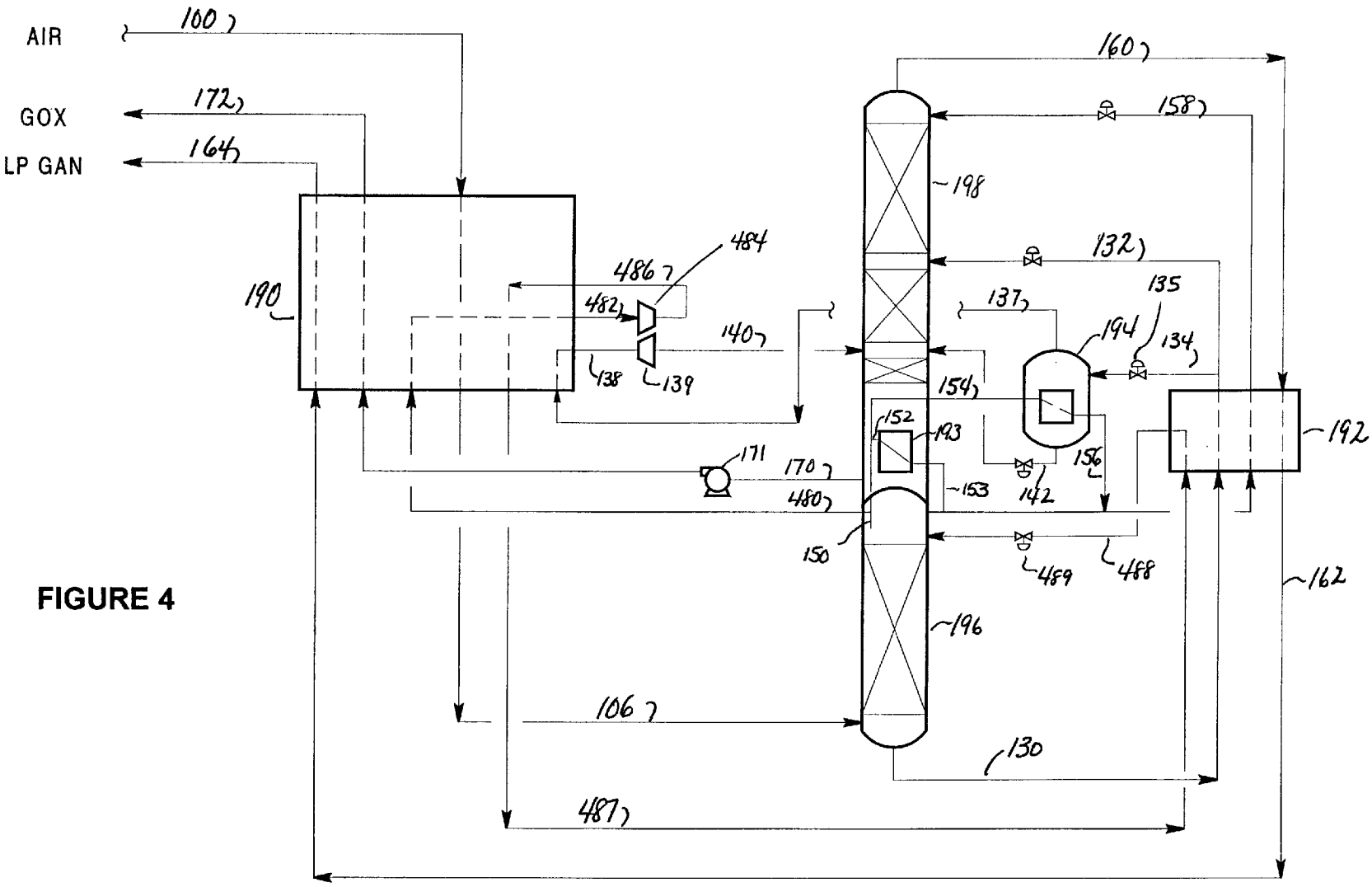

The additional work energy extracted from the expander can be used to cold compress any suitable process stream. While FIGS. 1–3 show the cold compression of a portion of the feed air stream which is then condensed against the pumped LOX stream, it is possible to directly cold compress a gaseous oxygen stream. This gaseous oxygen stream may be directly withdrawn from the bottom of the LP column or it could be obtained after the pumped LOX from pump 171 has been vaporized against a suitable process stream. It is also possible to cold compress a stream rich in nitrogen. This nitrogen-rich vapor stream for cold compression can come from any source such as the LP column or HP column. FIG. 4 shows a variation where this nitrogen-rich vapor stream is withdrawn from the HP column. All the features of FIG. 4 are the same as FIG. 1 except that pumped liquid oxygen from pump 171 is not vaporized by latent heat exchange against a cold compressed air stream but against the cold compressed nitrogen stream from the HP column. While the nitrogen-rich stream for cold compression can be withdrawn from any suitable location of the HP column, in FIG. 4, it is shown to be withdrawn from the top of the HP column as stream 480. This stream 480 is then partially warmed (optional) in the main heat exchanger, cold compressed in 484, then condensed by latent heat exchange against the vaporizing liquid oxygen from pump 171. This condensed stream 487 is then sent to the distillation column system. In FIG. 4, if needed, nitrogen-rich stream 480 could be first warmed in the main heat exchanger to a temperature close to the ambient temperature and then boosted in pressure by an auxiliary compressor, then partially cooled in the main heat exchanger and then sent to the cold compressor 484. The advantage of cold compressing a nitrogen-rich stream and then condensing it against at least a portion of the liquid oxygen from pump 171 is that it provides significantly more nitrogen reflux to the distillation column system and this improves the recovery and/or purity of nitrogen product. For example, even though not shown in FIG. 4, one will be able to coproduce more high pressure nitrogen product from FIG. 4 than from the corresponding FIG. 1.

Figure 5:
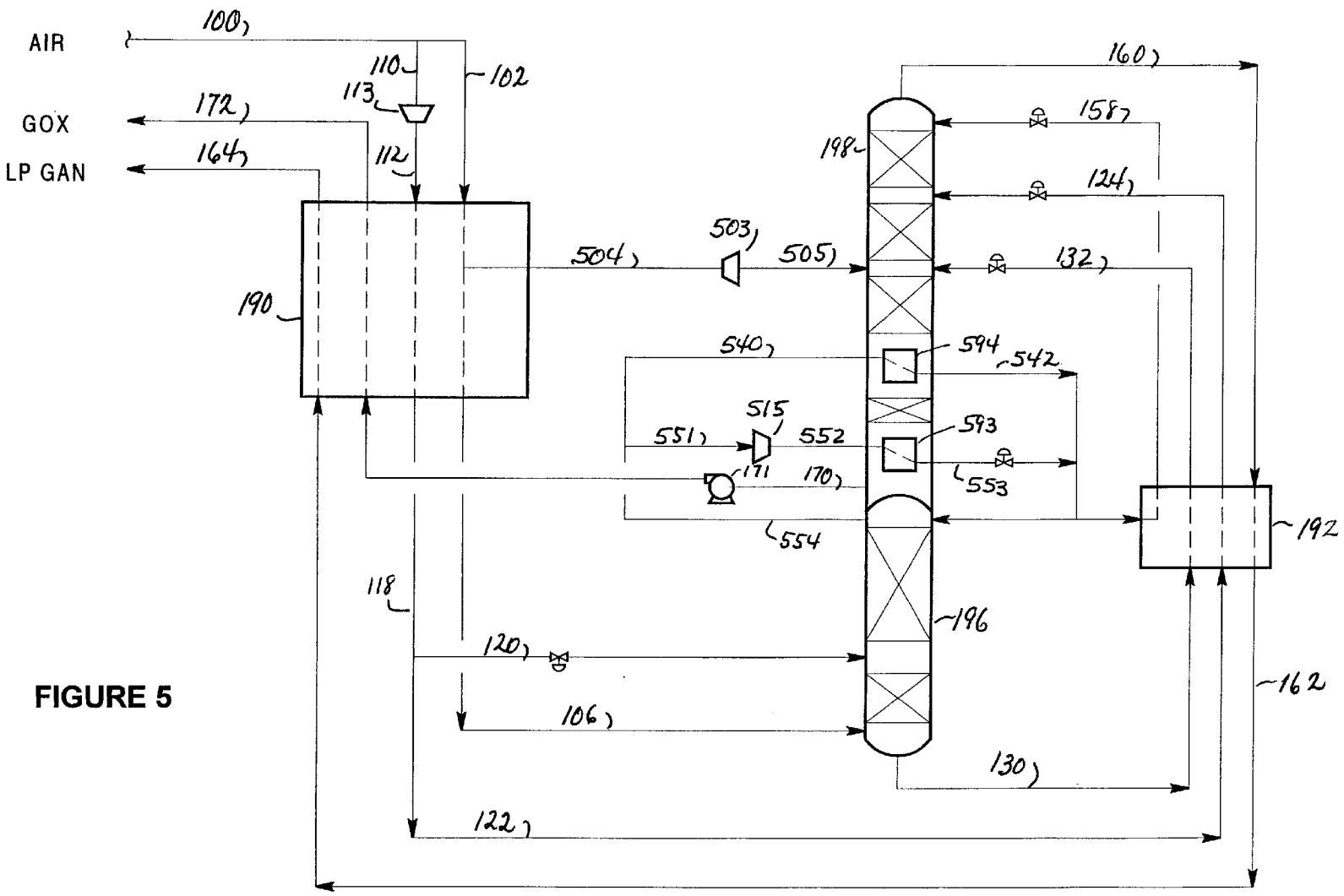

It should be emphasized that the purpose of cold compression is not limited to raising the pressure of oxygen. It can be used to cold compress any suitable process stream in step (b) of the invention. For example, in FIG. 4, either a portion or all of the cold compressed nitrogen stream 486 may not be condensed by further cooling but further warmed in the main heat exchanger to provide a pressurized nitrogen product stream. Another example is shown in FIG. 5. There are two differences between this example and the one in FIG. 3. The first difference is that all the high pressure nitrogen stream from the top of the HP column 196 is withdrawn in line 554. This stream is divided into two streams 540 and 551. While stream 540 is further treated in a manner analogous to treatment of stream 240 in FIG. 3, stream 551 is cold compressed according to step (b) of the invention. The cold compressed stream 552 is not condensed against the pumped liquid oxygen from pump 171, but is condensed by latent heat exchange against the liquid in the bottom reboiler/condenser 593 of the LP column. This provides the needed boil-up at the bottom of the LP column. The condensed liquid nitrogen streams in line 542 and 553 are then sent as reflux to the HP and LP columns. The cold compressed nitrogen stream in line 552 may be partially cooled by heat exchange against any suitable process stream prior to condensation in reboiler/condenser 593. These examples clearly illustrate that the present invention can be used to cold compress any suitable process stream. Furthermore, 540 and 551 need not be of the same composition, i.e. each could be drawn from different locations of the HP column.

The second difference between the process of FIG. 5 and FIG. 3 is the method by which refrigeration is created. Now according to step (a)(3), a portion of the feed air stream is work expanded to provide the needed refrigeration and energy for cold compression. For this purpose, after the portion of the feed air stream in line 102 is partially cooled in the main heat exchanger, a portion is withdrawn in line 504. This portion in line 504 is then work expanded in the expander 503 and fed to the LP column (stream 505).

So far, all the example flowsheets show at least two reboiler/condensers. However, it should be emphasized that the present invention does not preclude the possibility of using additional reboiler/condensers in the LP column than those shown in FIGS. 1–5. If needed, more reboilers/condensers may be used in the bottom section of the LP column to further distribute the generation of vapor in this section. Any suitable process stream may be either totally or partially condensed in these additional reboilers/condensers. From the known art, it is easy to draw many such examples using the present invention. For illustration, one may consider the possibility of partially or totally condensing a portion of the feed air in a bottom reboiler/condenser of the LP column. Also, the possibility of condensing a vapor stream withdrawn from an intermediate height of the HP column in a reboiler/condenser located in the LP column may be considered. In such situations, when either an air stream or a stream withdrawn from the HP column that contains significant quantities of oxygen is partially condensed, the uncondensed vapor fraction can provide the first process stream of step (a)(1) or the second process stream of step (a)(2).

In all those process schemes of the present invention, where work is extracted by the method taught in step (a)(1), all of the first process stream after work expansion may not be condensed by latent heat exchange as taught by step (a)(1). A portion of this stream may be recovered as a product stream or used for some other purpose in the process scheme. For example, in the process schemes shown in FIGS. 2–3, at least a portion of the high pressure nitrogen stream from the high pressure column is work expanded in expander 139 according to step (a)(1) of the invention. A portion of the stream exiting the expander 139 may be further warmed in the main heat exchanger and recovered as a nitrogen product at medium pressure from any one of these process flowsheets.

Figure 6:
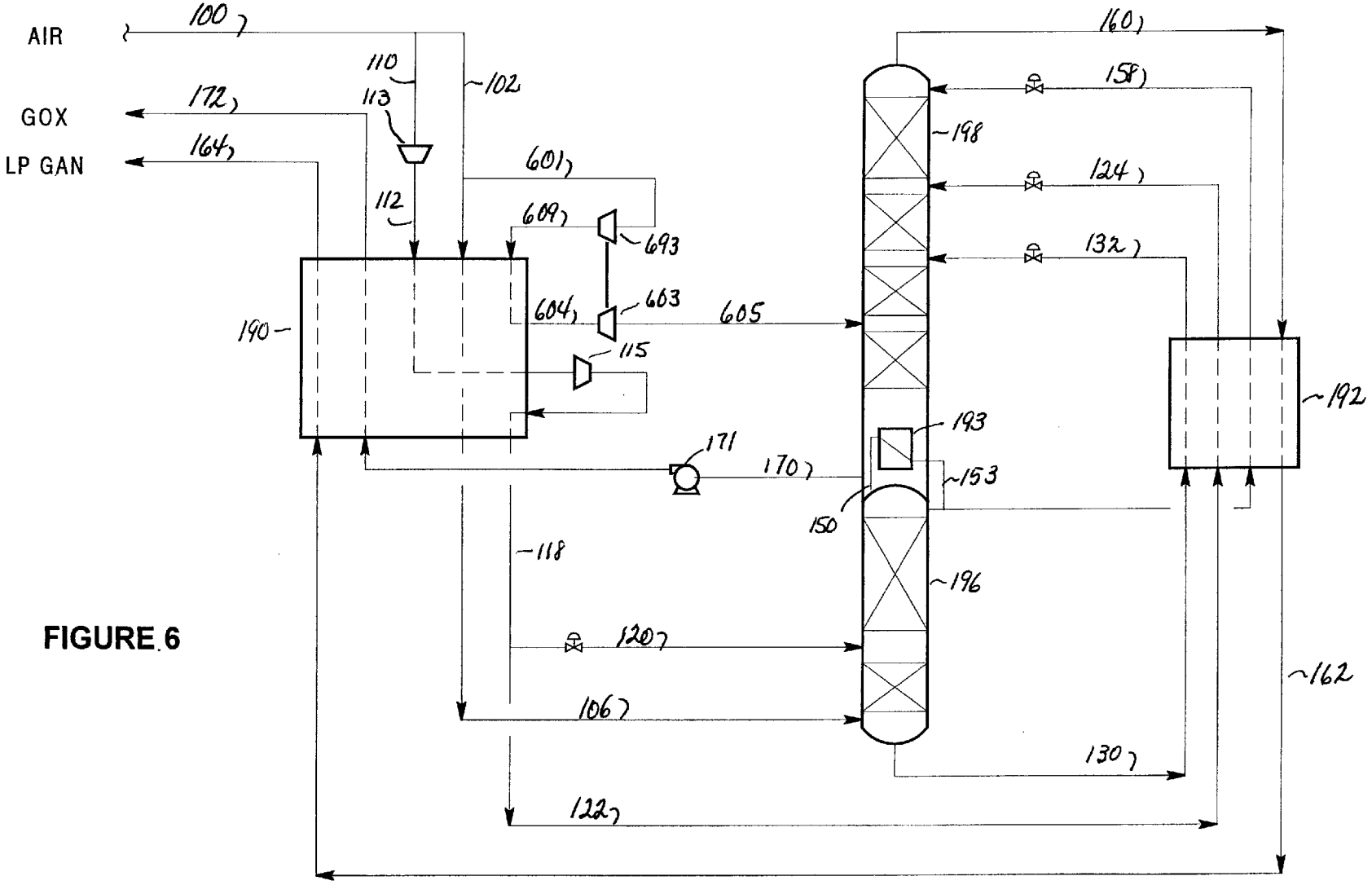

When a portion of the feed air is work expanded according to step (a)(3), it may be precompressed at near ambient temperatures, prior to feeding it to the main heat exchanger, by using the work energy that is extracted from the cold box. For example, in FIG. 6, stream 601 is withdrawn from the portion of the feed air in line 102; the withdrawn stream is then boosted in compressor 693 then cooled with cooling water (not shown in the figure) and further cooled in the main heat exchanger to provide stream 604. This stream 604 is further treated in a manner analogous to the treatment of stream 504 in FIG. 5. At least a portion of the work energy needed to drive compressor 693 is derived from the expander in the cold box. In FIG. 6, it is shown that compressor 693 is solely driven by expander 603. An advantage of using such a system, as compared to the one in FIG. 5, is that it provides a potential to extract more excess work from the expander and therefore, more work energy would be available for cold compression. An alternative to pressure boosting of a portion of the feed air stream in line 601, it is possible to first warm another process stream which is to be work expanded in the cold box, boost its pressure in a compressor such as 693, partially cool it in appropriate heat exchangers and then feed it to an appropriate expander.

There are several methods of transferring extra work energy to the cold compressor. For illustration purpose, some of the alternative methods are listed below:

All the work extracted from the expander may be used external to the cold box and the cold compressor in step (b) of the invention may be driven by an electric motor. For this purpose, the expander may be generator loaded to generate electricity or loaded with a warm compressor to compress a process stream at ambient or above ambient temperatures.

It may be possible to directly couple the expander to the cold compressor. In such a case, the expander will impart at least a portion of the work needed for the cold compression. Also, the expander will be loaded external to the cold box to provide the needed refrigeration for the cold box.

Finally, the method taught in this invention can be used when there are coproducts besides the low-purity oxygen with oxygen content less than 99.5%. For example, a high purity (99.5% or greater oxygen content) oxygen could be coproduced from the distillation system. One method of accomplishing this task is to withdraw low-purity oxygen from the LP column at a location which is above the bottom and withdraw a high purity oxygen from the bottom of the LP column. If the high purity oxygen stream is withdrawn in the liquid state, then it could be further boosted in pressure by a pump and then vaporized by heat exchange against a suitable process stream. Similarly, a high purity nitrogen product stream at elevated pressure could be coproduced. One method of accomplishing this task would be to take a portion of the condensed liquid nitrogen stream from one of the suitable reboilers/condensers and pump it to the required pressure and then vaporize it by heat exchange with a suitable process stream.

The value of the present invention is that it leads to substantial reduction in the energy consumption. This will be demonstrated by comparing the process of FIG. 2 with and without the cold compressor 115.

Calculations were made for the production of 95% oxygen product at 200 psia. For all flowsheets, the discharge pressure from the final stage of the main feed air compressor was about 5.3 bar absolute. The pressure at the top of the LP column was about 1.25 bar absolute. The net power consumption was computed by calculating the power consumed in the main feed air compressor, the booster air compressor 113 to vaporize pumped liquid oxygen, and taking credit for electrical power generated from the expander. The relative power consumption for the process in FIG. 2 with respect to the same process, but with no cold compressor 115, is 0.988. The superior performance of the present invention is now clear.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. In a process for the cryogenic distillation of air in a distillation column system that contains at least one distillation column wherein the boil-up at the bottom of the distillation column producing the oxygen product is provided by condensing a stream whose nitrogen concentration is equal to or greater than that in the feed air stream, the improvement which comprises the steps of:

(a) generating work energy which is in excess of the overall refrigeration demand of the distillation column system by at least one of the following three methods:

(1) work expanding a first process stream with nitrogen content equal to or greater than that in the feed air and then condensing at least a portion of the expanded stream by latent heat exchange with at least one of the two liquids: (i) a liquid at an intermediate height in the distillation column producing oxygen product and (ii) one of the liquid feeds to this distillation column having an oxygen concentration equal to or preferably greater than the concentration of oxygen in the feed air;

(2) condensing at least a second process stream with nitrogen content equal to or greater than that in the feed air by latent heat exchange with at least a portion of an oxygen-enriched liquid stream which has oxygen concentration equal to or preferably greater than the concentration of oxygen in the feed air and which is also at a pressure greater than the pressure of the distillation column producing oxygen product, and after vaporization of at least a portion of oxygen-enriched liquid into a vapor fraction due to latent heat exchange, work expanding at least a portion of the resulting vapor stream; and (3) work expanding a fraction of the feed air;

(b) using the work which is generated in excess of the refrigeration need of the distillation column system to cold compress a process stream at a temperature lower than the ambient temperature.

2. The process according to claim 1 wherein the distillation column system comprises a higher pressure column and lower pressure column.

3. The process according to claim 2 wherein the first process stream in step (a)(1) is a vapor stream withdrawn from the higher pressure column.

4. The process according to claim 2 wherein the first process stream in step (a)(1) is a portion of feed air.

5. The process according to claim 2 wherein the first process stream in step (a)(1) is the vapor resulting from the partial condensation of at least a portion of feed air.

6. The process according to claim 2 wherein said first process stream is condensed by at least partially vaporizing a liquid derived from an intermediate location of the lower pressure column.

7. The process according to claim 2 wherein said first process stream is condensed by at least partially vaporizing at least a portion of an oxygen enriched liquid which is withdrawn from the higher pressure column.

8. The process according to claim 2 wherein said first process stream is condensed by at least partially vaporizing at least a portion of an oxygen enriched liquid which is derived from at least partially condensing at least a portion of the feed air.

9. The process according to claim 2 wherein at least a portion of said first process stream is pumped and sent to the higher pressure column after condensation.

10. The process according to claim 2 wherein at least a portion of said first process stream is pumped and vaporized in a heat exchanger to provide a product.

11. The process according to claim 2 wherein all of said first process stream is sent to the lower pressure column as a feed after condensation.

12. The process according to claim 2 wherein the second process stream in step (a)(2) is a vapor withdrawn from the higher pressure column.

13. The process according to claim 2 wherein the second process stream in step (a)(2) is a portion of feed air at a pressure less than the higher pressure column.

14. The process according to claim 2 wherein the second process stream in step (a)(2) is the vapor resulting from the partial condensation of at least a portion of feed air and said vapor is at a pressure less than the higher pressure column.

15. The process according to claim 2 wherein said second process stream has been work expanded prior to condensation.

16. The process according to claim 2 wherein said second process stream is condensed by at least partially vaporizing a liquid derived from an intermediate location of the lower pressure column and said liquid is pumped prior to vaporization.

17. The process according to claim 2 wherein said second process stream is condensed by at least partially vaporizing at least a portion of an oxygen enriched liquid which is withdrawn from the higher pressure column.

18. The process according to claim 2 wherein said second process stream is condensed by at least partially vaporizing at least a portion of an oxygen enriched liquid which is derived from at least partially condensing at least a portion of the feed air.

19. The process according to claim 2 wherein at least a portion of said second process stream is pumped, if necessary, and sent to the higher pressure column after condensation.

20. The process according to claim 2 wherein at least a portion of said second process stream is pumped and vaporized in a heat exchanger to provide a product.

21. The process according to claim 2 wherein all of said second process stream is sent to the lower pressure column as a feed after condensation.

22. The process according to claim 2 wherein said work expanded fraction of feed air stream from step (a)(3) is eventually fed to the lower pressure column.

23. The process according to claim 2 wherein said work expanded fraction of feed air stream from step (a)(3) is eventually fed to the higher pressure column.

24. The process according to claim 2 wherein the process stream to be compressed in step (b) is at least a portion of feed air.

25. The process according to claim 24 wherein the oxygen product is withdrawn from the lower pressure column as a liquid and eventually boiled and said feed air used for step (b), after it's cold compression, is at least partially condensed by indirect heat exchange with the boiling oxygen.

26. The process according to claim 25 wherein said feed air used for step (b) is also compressed warm prior to being cooled and subsequently compressed cold.

27. The process according to claim 2 wherein the process stream to be cold compressed in step (b) is a vapor withdrawn from the higher pressure column .

28. The process according claim 27 wherein the oxygen product is withdrawn from the lower pressure column as a liquid and eventually boiled and at least a portion of said higher pressure column vapor for step (b), after it's cold compression, is at least partially condensed by indirect heat exchange with the boiling oxygen.

29. The process according to claim 27 wherein said higher pressure column vapor for step (b) is warmed to ambient following the cold compression, then further compressed.

30. The process according to claim 29 wherein the oxygen product is withdrawn from the lower pressure column as a liquid and eventually boiled and at least a portion of said warm compressed higher pressure column vapor is cooled then at least partially condensed by indirect heat exchange with the boiling oxygen.

31. The process according to claim 27 wherein said higher pressure column vapor for step (b) is warmed to ambient then compressed and at least a portion is subsequently cooled then cold compressed.

32. The process according to claim 31 wherein the oxygen product is withdrawn from the lower pressure column as a liquid and eventually boiled and said cold compressed higher pressure column vapor is at least partially condensed by indirect heat exchange with the boiling oxygen.

33. The process according to claim 27 wherein at least of portion of said higher pressure column vapor for step (b) constitutes a nitrogen enriched product.

34. The process according to claim 27 wherein said higher pressure column vapor for step (b) is at least partially condensed in the main reboiler-condenser located in the lower pressure column following cold compression.

35. The process according to claim 2 wherein the process stream to be compressed in step (a)(2) is a vapor withdrawn from the top of the lower pressure column and constitutes a nitrogen-enriched product.

36. The process according to claim 2 wherein the process stream to be compressed in step (b) is a vapor withdrawn from the bottom of the lower pressure column and constitutes an oxygen product.

37. The process according to claim 1 wherein the expander used in step (a) is direct coupled to the cold compressor used in step (b).

* * * * *